US008568170B2

(12) United States Patent
Lan et al.

(10) Patent No.: US 8,568,170 B2
(45) Date of Patent: Oct. 29, 2013

(54) ELECTRICAL CONNECTOR

(75) Inventors: Rong-Qin Lan, Guang-Dong (CN); Li-Jun Xu, Guang-Dong (CN); Ming-Han Lin, New Taipei (TW)

(73) Assignee: Cheng Uei Precision Industry Co., Ltd., New Tapei (TW)

( * ) Notice: Subject to any disclaimer, the term of this patent is extended or adjusted under 35 U.S.C. 154(b) by 0 days.

(21) Appl. No.: 13/371,362

(22) Filed: Feb. 10, 2012

(65) Prior Publication Data

US 2013/0210274 A1 Aug. 15, 2013

(51) Int. Cl.
*H01R 13/648* (2006.01)

(52) U.S. Cl.
USPC ..... 439/607.05

(58) Field of Classification Search
USPC ..... 439/607.05, 83, 79, 607.36, 95, 108
See application file for complete search history.

(56) References Cited

U.S. PATENT DOCUMENTS

| | | | | |
|---|---|---|---|---|
| 5,928,035 | A * | 7/1999 | Jankowsky et al. | 439/607.36 |
| 6,210,232 | B1 * | 4/2001 | Lai et al. | 439/620.08 |
| 7,351,105 | B2 * | 4/2008 | Delaney et al. | 439/607.36 |
| 7,682,172 | B2 * | 3/2010 | Lu | 439/181 |
| 2009/0142946 | A1 * | 6/2009 | Lu | 439/95 |
| 2012/0077390 | A1 * | 3/2012 | Tsai | 439/660 |
| 2012/0302076 | A1 * | 11/2012 | Tsai | 439/131 |

* cited by examiner

*Primary Examiner* — Alexander Gilman
(74) *Attorney, Agent, or Firm* — Cheng-Ju Chiang

(57) ABSTRACT

An object of the present invention is to provide an electrical connector. The electrical connector includes an insulating housing having a base body and a tongue portion protruding forwards from a front of the base body. A substantial middle of a rear of the base body is concaved forward to form a receiving space. A fixing body is assembled in the receiving space of the insulating housing. A plurality of terminals is molded in the fixing body. A metal shell sheathes rearward the insulating housing together with the fixing body and the terminals. The metal shell has a rear plate curved downward by an external jig to cover a rear side of the fixing body after the metal shell sheathes the insulating housing.

6 Claims, 4 Drawing Sheets

ELECTRICAL CONNECTOR

BACKGROUND OF THE INVENTION

1. Field of the Invention

The present invention relates to an electrical connector, and more particularly to an electrical connector capable of preventing dirt from entering an electrical product where the electrical connector is assembled.

2. The Related Art

A traditional electrical connector (shown in FIG. 1) generally includes an insulating housing 10', a plurality of terminals 20' and a shielding shell 30'. The insulating housing 10' has a base body 11' and a tongue portion 12' protruding forward from a middle of a front of the base body 11'. A bottom of the tongue portion 12' defines a plurality of terminal grooves (not shown) each penetrating rearward through the base body 11'. The terminals 20' are inserted forward in the terminal grooves respectively. The shielding shell 30' encloses the insulating housing 10' together with the terminals 20'. However, since rears of the terminal grooves must be large enough for the convenience of inserting the terminals 20' into the terminal grooves in assembly, there are often intervals between rear ends of the terminals 20' and periphery inner sides of the rears of the terminal grooves after the terminals 20' are assembled in the terminal grooves of the insulating housing 10'. As a result, it is also easy enough for dirt to enter an electronic product connected with the electrical connector from the intervals.

SUMMARY OF THE INVENTION

An object of the present invention is to provide an electrical connector. The electrical connector includes an insulating housing having a base body and a tongue portion protruding forwards from a front of the base body. A substantial middle of a rear of the base body is concaved forward to form a receiving space. A bottom of the tongue portion defines a plurality of terminal grooves each extending along a front-to-rear direction to connect with the receiving space. A fixing body is assembled in the receiving space of the insulating housing. A plurality of terminals is molded in the fixing body. Each terminal has a contacting portion partially projecting downward out of the terminal groove, and a soldering portion stretching behind the fixing body. A metal shell sheathes rearward the insulating housing together with the fixing body and the terminals. The metal shell has a rear plate curved downward by an external jig to cover a rear side of the fixing body after the metal shell sheathing the insulating housing.

As described above, the terminals are molded in the fixing body and then assembled in the insulating housing along with the fixing body, the metal shell sheathes rearward the insulating housing together with the fixing body and the terminals, and the metal shell has the rear plate curved downward by an external jig to cover the rear side of the fixing body after the metal shell sheathes the insulating housing, so the electrical connector can effectively prevent dirt from entering electrical products where the electrical connector is assembled.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
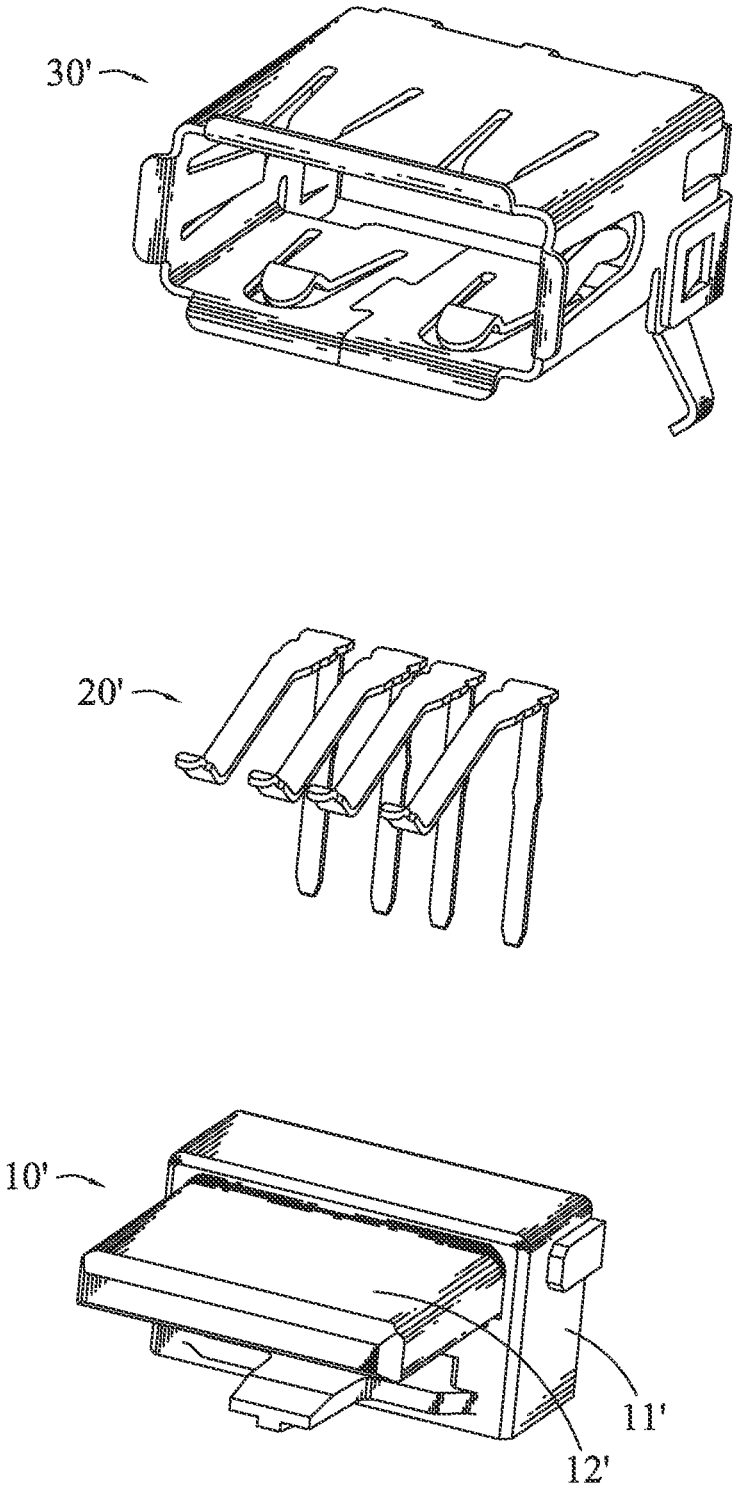
FIG. 1 (PRIOR ART)
FIG. 1 is an exploded perspective view of a traditional electrical connector.
Figure 2:
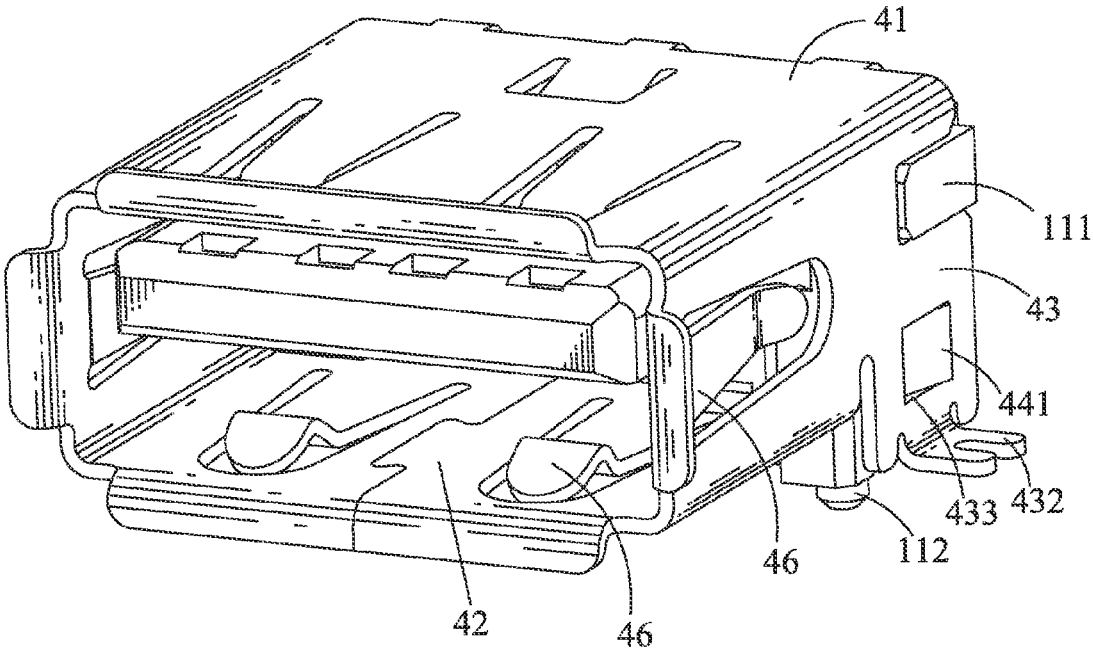
FIG. 2 is an assembled perspective view of an electrical connector in accordance with an embodiment of the present invention.
Figure 3:
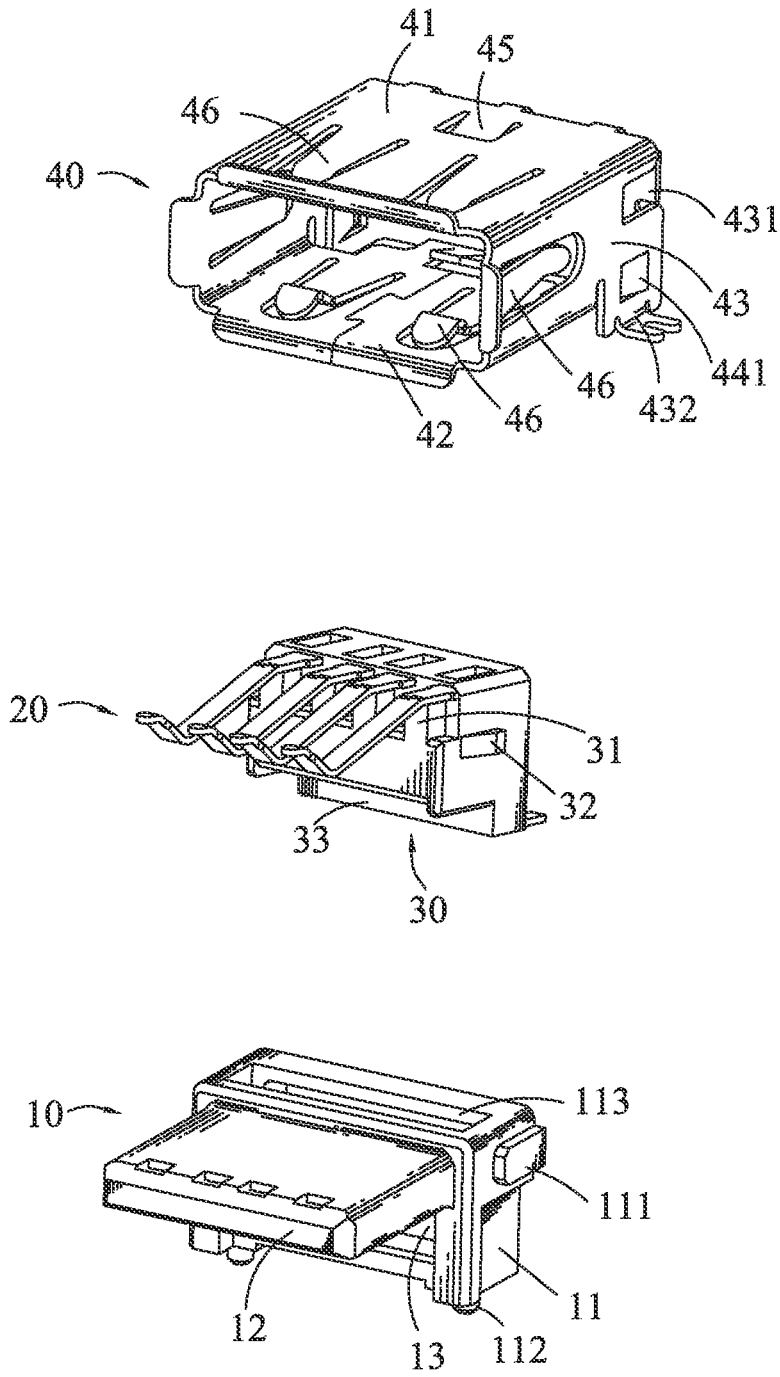
FIG. 3 and FIG. 4 are exploded perspective views of the electrical connector shown in FIG. 2.
Figure 4:
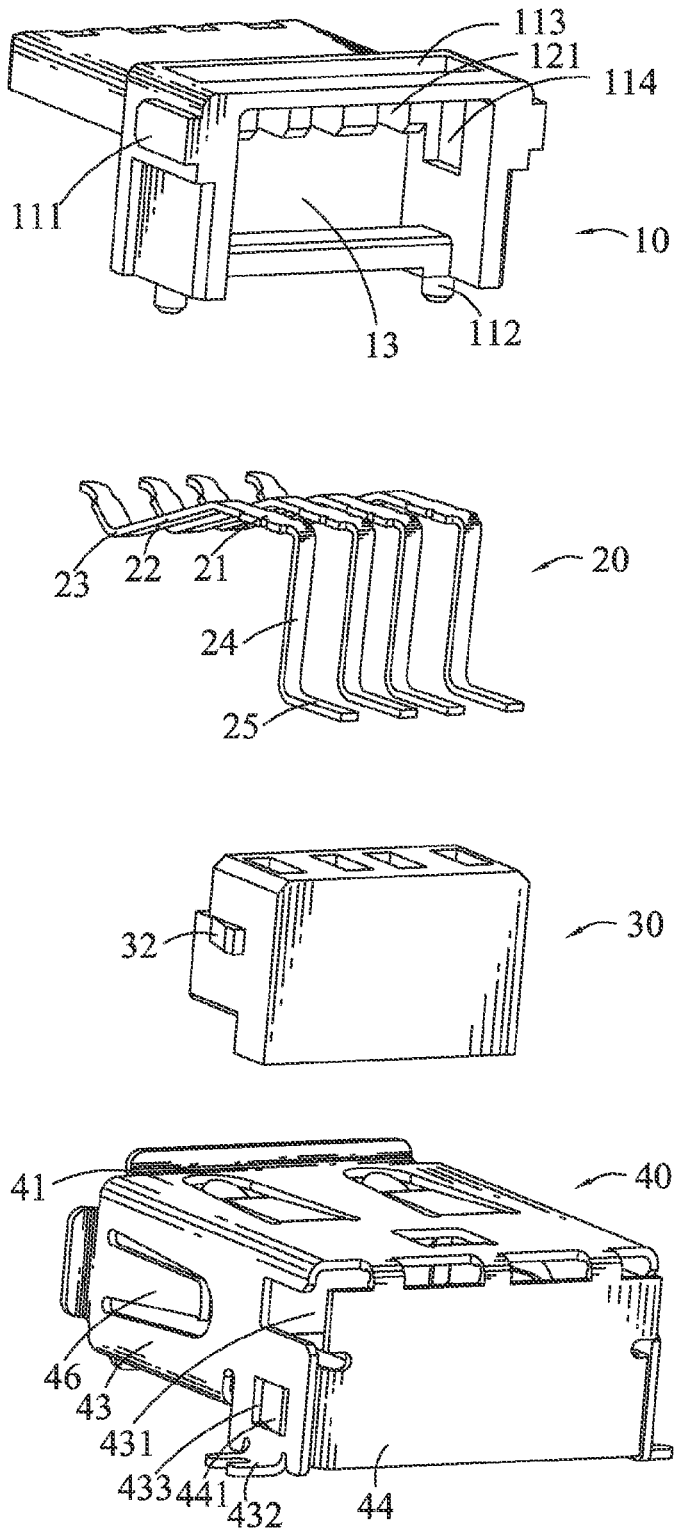

Referring to FIGS. 2-4, an electrical connector according to an embodiment of the present invention includes an insulating housing 10, a plurality of terminals 20, a fixing body 30 and a metal shell 40.

Referring to FIG. 3 and FIG. 4, the insulating housing 10 has a base body 11 and a tongue portion 12 protruding forwards from a front of the base body 11. Two opposite outer sides of the base body 11 of the insulating housing 10 protrude outward to form two blocks 111. A bottom of the base body 11 protrudes downward to form two fixing pillars 112. A buckling fillister 113 is opened in a top of the base body 11 of the insulating housing 10. A substantial middle of a rear of the base body 11 is concaved forward to form a receiving space 13. A bottom of the tongue portion 12 defines a plurality of terminal grooves 121 each extending along a front-to-rear direction to connect with the receiving space 13. Two face-to-face inner sides of the receiving space 13 define a blocking groove 114 respectively.

Referring to FIGS. 2-4, the fixing body 30 is assembled in the receiving space 13 of the insulating housing 10. Each of the terminals 20 has a fastening portion 21. A front end of the fastening portion 21 slantwise extends forward to form a spring arm 22 of which a free end is arched downward to form a contacting portion 23. A rear end of the fastening portion 21 extends downward to form a connecting portion 24 of which a bottom end bends rearward to form a soldering portion 25. A rear of the fastening portion 21 and the connecting portion 24 are molded in the fixing body 30. A front of the fastening portion 21 stretches beyond a front side of the fixing body 30 and is held in the terminal groove 121. The spring arm 22 elastically stretches in the terminal groove 121 with the contacting portion 23 partially projecting downward out of the terminal groove 121, and the soldering portion 25 stretches behind the fixing body 30.

Referring to FIGS. 2-3, a front side of the fixing body 30 protrudes forward to form a plurality of positioning pillars 31 inserted in the terminal grooves 121 of the insulating housing 10 respectively to reinforce the fronts of the fastening portions 21 of the terminals 20 in the corresponding terminal grooves 121. Two opposite outer sides of the fixing body 30 define a wedge 32 respectively buckled in the blocking groove 114 of the insulating housing 10. A bottom of the fixing body 30 defines a fastening fillister 33 penetrating through a front of the fixing body 30.

Referring to FIGS. 2-4, the metal shell 40 sheathes rearward the insulating housing 10 together with the fixing body 30 and the terminals 20. The metal shell 40 has a top plate 41, two side plates 43 extending downward from two opposite side edges of the top plate 41, and two bottom plates 42 extending towards each other from two bottom edges of the side plates 43 and wedged together. Rear ends of the bottom plates 43 pass through a bottom of the receiving space 13 to be inserted in the fastening fillister 33. The top plate 41 and the bottom plates 42 of the metal shell 40 are die-cut inward to form a plurality of buckling slices 45 buckled in the buckling fillister 113 of the base body 10 and abutting against a top inner side of the fastening fillister 33 of the fixing body 30, respectively. A rear plate 44 is connected with a rear edge of the top plate 41 and curved downward by an external jig to cover a rear side of the fixing body 30 after the metal shell 40 sheathes the insulating housing 10. Two opposite sides of the rear plate 44 bend forward to form a pair of buckling plates (not labeled) abutting against inner sides of rears of the side plates 43. The rear of each side plate 43 defines a bucking hole 433. A buckling ear 441 protrudes outward on the buckling plate and is buckled in the buckling hole 433. The rear of the side plate 43 further defines a gap 431 for buckling the corresponding block 111 of the insulating housing 10 therein. The bottom edge of the rear of each side plate 43 is bent outward to form a soldering tail 432. The top plate 41, the side plates 43 and the bottom plates 42 of the metal shell 40 are punched inward to form a plurality of resisting slices 46 for interfering with a mating connector (not shown).

As described above, the terminals 20 are molded in the fixing body 30 and then assembled in the insulating housing 10 along with the fixing body 30, the metal shell 40 sheathes rearward the insulating housing 10 together with the fixing body 30 and the terminals 20, and the metal shell 40 has the rear plate 44 curved downward by an external jig to cover the rear side of the fixing body 30 after the metal shell 40 sheathes the insulating housing 10, so the electrical connector can effectively prevent dirt from entering electrical products where the electrical connector is assembled.

What is claimed is:

1. An electrical connector, comprising:

an insulating housing having a base body, a tongue portion protruding forwards from a front of the base body, a substantial middle of a rear of the base body being concaved forward to form a receiving space, a bottom of the tongue portion defining a plurality of terminal grooves each extending along a front-to-rear direction to connect with the receiving space;

a fixing body assembled in the receiving space of the insulating housing;

a plurality of terminals molded in the fixing body, each terminal having a contacting portion partially projecting downward out of the terminal groove, and a soldering portion stretching behind the fixing body; and a metal shell sheathing rearward the insulating housing together with the fixing body and the terminals, the metal shell having a rear plate curved downward by an external jig to cover a rear side of the fixing body after the metal shell sheathes the insulating housing;

wherein a front side of the fixing body protrudes forward to form a plurality of positioning pillars inserted in the terminal grooves of the insulating housing respectively to reinforce the terminals in the corresponding terminal grooves.

2. The electrical connector as claimed in claim 1, wherein each of the terminals further has a fastening portion, a front end of the fastening portion slantwise extends forward to form a spring arm of which a free end are arched downward to form the contacting portion, a rear end of the fastening portion extends downward to form a connecting portion of which a bottom end bends rearward to form the soldering portion, a rear of the fastening portion and the connecting portion are molded in the fixing body, a front of the fastening portion stretches beyond a front side of the fixing body and is held in the terminal groove by the corresponding positioning pillar of the fixing body, the spring arm elastically stretches in the terminal groove.

3. The electrical connector as claimed in claim 1, wherein two face-to-face inner sides of the receiving space define a blocking groove respectively, two opposite outer sides of the fixing body define a wedge respectively buckled in the blocking groove.

4. An electrical connector, comprising:

an insulating housing having a base body, a tongue portion protruding forwards from a front of the base body, a substantial middle of a rear of the base body being concaved forward to form a receiving space, a bottom of the tongue portion defining a plurality of terminal grooves each extending along a front-to-rear direction to connect with the receiving space;

a fixing body assembled in the receiving space of the insulating housing;

a plurality of terminals molded in the fixing body, each terminal having a contacting portion partially projecting downward out of the terminal groove, and a soldering portion stretching behind the fixing body; and a metal shell sheathing rearward the insulating housing together with the fixing body and the terminals, the metal shell having a rear plate curved downward by an external jig to cover a rear side of the fixing body after the metal shell sheathes the insulating housing;

wherein the metal shell has a top plate, two side plates extending downward from two opposite side edges of the top plate, and two bottom plates extending towards each other from two bottom edges of the side plates and wedged together, the rear plate is connected with a rear edge of the top plate and two opposite sides thereof bend forward to form a pair of buckling plates abutting against inner sides of rears of the side plates, the rear of each side plate defines a bucking hole, a buckling ear protrudes outward on the buckling plate and is buckled in the buckling hole, a bottom of the fixing body defines a fastening fillister penetrating through a front of the fixing body, and rear ends of the bottom plates pass through a bottom of the receiving space to be inserted in the fastening fillister.

5. The electrical connector as claimed in claim 4, wherein a buckling fillister is opened in a top of the base body of the insulating housing, the top plate and the bottom plates are die-cut inward to form a plurality of buckling slices buckled in the buckling fillister of the base body and abutting against a top inner side of the fastening fillister of the fixing body, respectively.

6. The electrical connector as claimed in claim 4, wherein the rear of the side plate further defines a gap, two opposite outer sides of the base body of the insulating housing protrude outward to form two blocks buckled in the gaps respectively.

* * * * *